United States Patent [19]

Goettl

[11] 4,200,599

[45] Apr. 29, 1980

[54] MOISTURE ENTRAINMENT BAFFLE FOR EVAPORATIVE COOLERS

[76] Inventor: Adam D. Goettl, 4960 E. Palomino Rd., Phoenix, Ariz. 85018

[21] Appl. No.: 913,889

[22] Filed: Jun. 8, 1978

[51] Int. Cl.[2] ..... B01F 3/04

[52] U.S. Cl. ..... 261/97; 261/106; 261/DIG. 44

[58] Field of Search ..... 261/97, 110, 113, 114 A, 261/114 JP, DIG. 11, DIG. 41, DIG. 44, DIG. 4, 105, 106

[56] References Cited

U.S. PATENT DOCUMENTS

| | | | |
|---|---|---|---|
| 2,319,814 | 5/1943 | Harmon | 261/113 |
| 2,590,779 | 3/1952 | Lehmann | 261/97 X |
| 2,827,270 | 3/1958 | Martin | 261/DIG. 44 |
| 2,850,269 | 9/1958 | Bohanon | 261/97 |
| 2,961,226 | 11/1960 | Goettl | 261/97 X |
| 3,197,183 | 7/1965 | Koble, Jr. | 261/97 X |
| 3,223,393 | 12/1965 | Goettl | 261/97 X |
| 3,322,405 | 5/1967 | Knudson et al. | 261/DIG. 44 |

*Primary Examiner*—Richard L. Chiesa
*Attorney, Agent, or Firm*—Herbert E. Haynes, Jr.

[57] ABSTRACT

A baffle is mounted in spaced coextending relationship with the water outlet slots formed in the water distribution troughs of the cooler pad assemblies of an evaporative cooler to block moisture entrainment which otherwise occurs as a result of high velocity air entering the interior of the evaporative cooler trough through the water outlet slots of the troughs.

11 Claims, 6 Drawing Figures

MOISTURE ENTRAINMENT BAFFLE FOR EVAPORATIVE COOLERS

BACKGROUND OF THE INVENTION

1. Field of the Invention

This invention relates to evaporative coolers and more particularly to a moisture entrainment baffle for use in the water distribution troughs of the cooler pads of an evaporative cooler.

2. Description of the Prior Art

In the well known highly developed art of evaporative coolers it is customary to locate an electrically driven centrifugal blower within the cooler cabinet to draw ambient air through wetted cooler pad assemblies which are mounted in the sides of the cabinet. Air moving through the pads is cooled by evaporation and supplied to a space to be cooled, such as a house, by the centrifugal blower. The cooler pad assemblies are wetted by the evaporative cooler's water distribution system which includes, among other things, an elongated V-shaped trough in each of the cooler pad assemblies for receiving water from a suitable plumbing network and distributing the received water evenly across the top of the pads through spaced slots formed in the troughs.

In such structures, the centrifugal blower creates a negative static pressure within the evaporative cooler cabinet and ambient air will move into the interior of the cabinet at relatively high velocities. The moistened cooler pads will offer some resistance to the movement of incoming ambient air, and wherever possible the air will move in air leakage paths of less resistance.

One such air leakage path entering into an evaporative cooler cabinet has been found to exist through the water outlet slots provided in the water distribution troughs, and this incoming air will entrain or pick up, moisture in the form of water droplets from the water in those troughs. The entrained moisture is deposited on the various components of the evaporative cooler, which, in addition to contributing to the corrosion and mineral deposition on the cooler components has, in some instances, caused failure of the electric motor used to drive the centrifugal blower.

To the best of my knowledge, no device has been developed or proposed for blocking the moisture entrained by air passing into an evaporative cooler through the water outlet slots formed in the water distribution troughs thereof.

Therefore, a need exists for a new and useful moisture entrainment baffle for use in evaporative coolers which overcomes some of the problems of the prior art.

SUMMARY OF THE INVENTION

In accordance with the present invention, a moisture entrainment baffle is mounted in spaced coextending relationship with the water outlet slots formed in each of the water distribution troughs located in the upper portion of the cooler pad assemblies of an evaporative cooler for blocking moisture entrainment which would otherwise result from high velocity air entering the interior of the evaporative cooler through the water outlet slots of the troughs.

The moisture entrainment baffle of the present invention substantially reduces the total amount of water entrained by high velocity air moving into the interior of an evaporative cooler and therefore, reduces corrosion, mineral deposition and premature component failures.

Accordingly, it is an object of the present invention to provide a new and useful moisture entrainment baffle for use in evaporative coolers.

Another object of the present invention is to provide a new and useful moisture entrainment baffle which eliminates the moisture entrainment caused by high velocity air entering into the interior of an evaporative cooler cabinet through the water outlet slots provided in the water distribution troughs of the evaporative cooler.

Another object of the present invention is to provide an improved cooler pad assembly for use in evaporative coolers which includes a moisture entrainment baffle mounted in the water distribution trough of the cooler pad assembly to block moisture entrainment which would otherwise result from air moving into the water distribution trough through the water outlet slots formed therein.

Another object of the present invention is to provide an improved cooler pad assembly of the above described character in which the moisture entrainment baffle includes a deflector plate disposed in spaced coextending relationship with the water outlet slots formed in the water distribution trough thereof.

Another object of the present invention is to provide an improved cooler pad assembly of the above described character in which the moisture entrainment baffle includes means for mounting a deflector plate in spaced coextending relationship with the water outlet slots formed in the water distribution trough thereof.

The foregoing objects of the present invention, as well as the invention itself, may be more fully understood from the following description when read in conjunction with the accompanying drawings.

DESCRIPTION OF THE PREFERRED EMBODIMENTS

Figure 1:
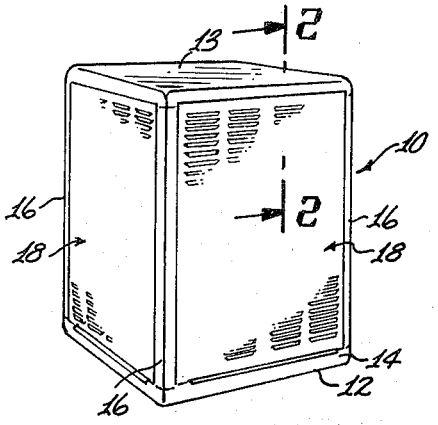
FIG. 1 is a perspective view of a typical evaporative cooler in which the moisture entrainment baffle of the present invention is useful.

Referring more particularly to the drawings, FIG. 1 illustrates a typical type of evaporative cooler which is indicated generally by the reference numeral 10. The evaporative cooler 10 includes a cabinet 12 formed with the usual inverted top pan 13, bottom or sump pan 14, interconnecting corner posts 16 and demountable cooler pad assemblies 18.

As is well known in the art, the evaporative coolers, such as the one shown in FIG. 1, are fabricated in various configurations such as the types known as "downdraft" and "sidedraft" models. In a downdraft model, the air outlet is located in the bottom of the cabinet and such a configuration, which is suitable for rooftop mounting, is provided with cooler pad assemblies in each side of the cabinet. The sidedraft model is suitable for mounting on a building wall in that the air outlet is located in one of the sides of the cabinet and a cooler pad assembly is located in each of the remaining sides of the cabinet.

In any event, all evaporative coolers are equipped with similar components and all function in the same basic manner which will now be briefly described. Although not shown, all coolers are provided with an air moving device such as a centrifugal blower, which is mounted in the cooler cabinet and the air moving device is normally driven by an electric motor which is also mounted in the cooler cabinet. When the air moving device (not shown) is operating, it creates a negative static pressure within the cooler cabinet 12 which results in ambient air moving into the cabinet through the cooler pad assemblies 18. The air moving into the cabinet is cooled by evaporation due to the cooler pad assemblies 18 being wetted by water, as will hereinafter be described, and the cooled air is drawn into the air moving device and exits the evaporative cooler through the outlet (not shown) of the cabinet.

As shown, a typical cooler pad assembly 18 is a substantially planar structure having an elongated V-shaped water distribution trough 20 extending along the top thereof. The trough 20 is formed with an outwardly disposed upstanding mounting flange 21, a spaced rearwardly disposed vertical flange 22 and integral downwardly converging trough walls 23 and 24. The trough wall 24 is provided with a plurality of spaced apart alignigly arranged water outlet slots 25 formed transversely therein. The outwardly disposed mounting flange 21 of the trough 20 has its upper portion looped over the top edge of the air inlet louver plate 26 and is crimped or otherwise affixed thereto to form a lip 27 which extends across the top of the cooler pad assembly 18. The rear flange 22 of the trough 20 serves as a retainer for the top of a removable open mesh wire grid 28 which holds a wettable fibrous pad 30 in a position which is interposed between the grid 28 and the louver plate 26, and immediately below the trough 20. The fibrous pad 30 normally consists of an excelsior material 31, such as aspen fiber, which is held in a pad-like configuration by a fabric netting 32 such as cheese cloth.

Water from a suitable source (not shown) for wetting fibrous pad 30 is supplied to a water distribution network (not shown) located in the cooler cabinet 12 adjacent the top pan 13 thereof. A branch line 34, which is part of the water distribution network, extends to a position above the trough 20 and is bent to provide a depending end which has a suitable nozzle 35 thereon. It should be noted that in some of the larger sized coolers, a spaced pair of such branch lines are employed to insure that a sufficient amount of water is supplied evenly to the trough.

In any event, water from the branch line 34 is received in the trough 20 and under proper operating conditions will partially fill the trough to a level which is above the lowermost portion of the water outlet slots 25. Thus, the water will trickle out of the trough 20 at a rate determined by the opening size of the slots 25 and will wet the fibrous pad 30 at a plurality of evenly spaced locations across the top thereof, and gravity will cause that water to wet the entire pad.

As hereinbefore mentioned, by far the largest percentage of incoming air will pass through the fibrous pads 30 into the cooler cabinet 12 with the remaining portions of incoming air entering the cabinet through various air leakage points about the cabinet. In general, such air leakage will be in comparatively small amounts and thus, will not seriously impair the operating efficiency of the evaporative cooler. However, as the fibrous pads 30 are used, they become contaminated such as with dust and dirt extracted from the incoming air, from mineral deposits resulting from the evaporation of water, and the like, as this contamination increases, the resistance to incoming air also increases which in turn results in an increase in both the amount and the velocity of air entering into the cabinet through the leakage points.

Figure 2:
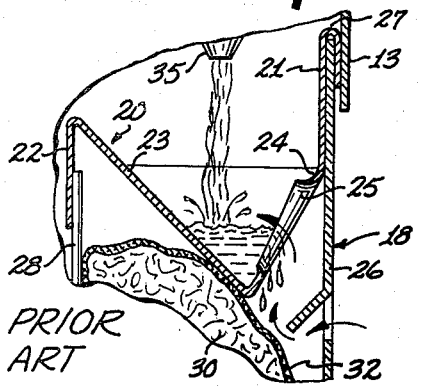
FIG. 2 is an enlarged fragmentary sectional view taken along the line 2—2 of FIG. 1 and illustrating the prior art.
Figure 3:
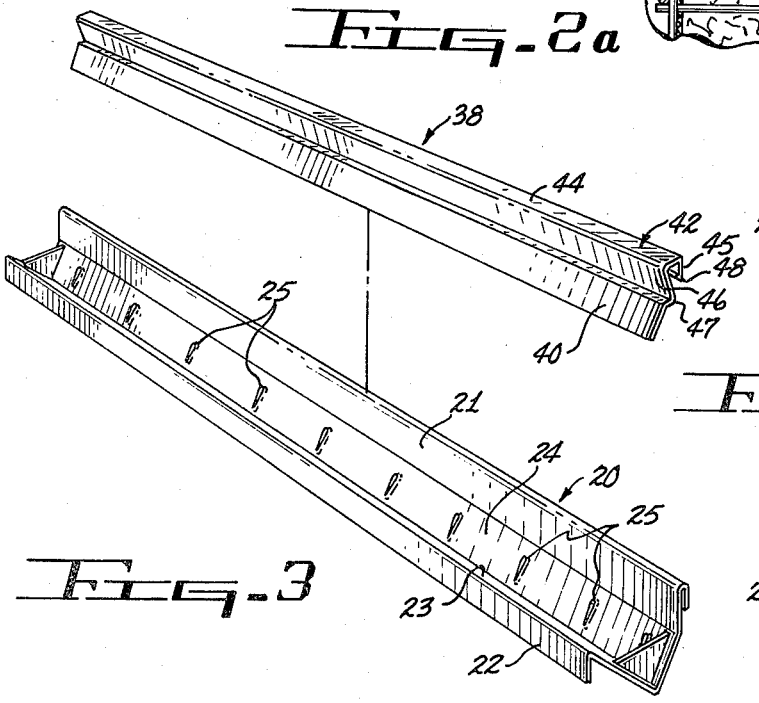
FIG. 3 is a perspective view of the moisture entrainment baffle of the present invention exploded from a typical type of water distribution trough.

Referring now to FIG. 2 in which the prior art is shown to facilitate explanation of an air leakage path which has been found to result in damage to the evaporative cooler. As shown by air flow arrows in FIG. 2, that air flow path is through the louvers of the louver plate 26, through the water outlet slots 25 of the trough 20 and into the interior of the cooler cabinet 12. It should be noted that the water outlet slots 25 are of what may be described as an inverted teardrop configuration, which as best seen in FIG. 3, results in an angularly upwardly diverging opening with the largest open portion being at the upper end thereof. Thus, in normal operation of the evaporative cooler, water will move out of the trough 20 through the narrow more restricted lower portions of the slots 25, and the previously described air leakage will move into the trough 20 through the larger more open upper portions of the slots 25. Such an air flow path is in extremely close proximity to the turbulent water that is trickling out of the slots 25, and water entrainment in the form of droplets results. The entrainment problem is compounded by splashing water from the branch line 34 which in some instances will be deflected by the downwardly converging trough walls 23 and 24, and in other instances will land in the water contained in the trough. In either case, splashing and sloshing results and the incoming air will carry some of the splashing water with it into the cooler cabinet 12. Moisture entrainment and splashing occurs at all times during operation of the prior art evaporative coolers, and will become very heavy when the fibrous pad 30 becomes contaminated which can cause the air moving in this leakage path to increase in velocity. The moisture being carried, as described above, into the cooler cabinet 12 will be deposited on the various components therein and this will, of course, contribute to corrosion, mineral deposition, and has been known to cause premature component failure such as burning out of the electric motor which drives the centrifugal blower (not shown).

Figure 2A:
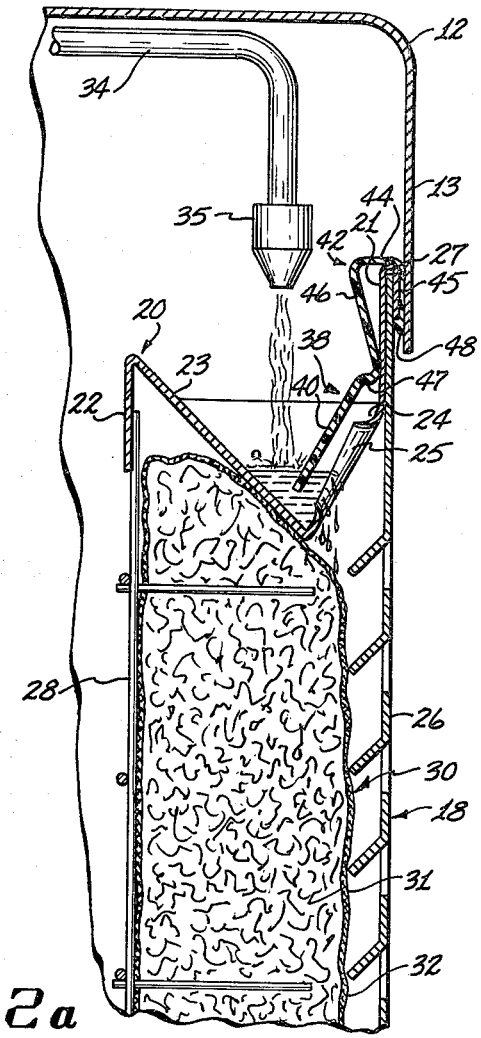
FIG. 2*a* is a fragmentary sectional view similar to FIG. 2 and showing the moisture entrainment baffle of the present invention mounted in the water distribution trough of an evaporative cooler pad assembly.

In accordance with the present invention, the above described moisture entrainment problem is eliminated by a moisture entrainment baffle which is shown in FIGS. 2*a* and 3 and is indicated generally by the reference numeral 38. As shown, the moisture entrainment baffle 38 is an elongated one-piece structure of suitable material such as plastic, metal or the like, which is extruded, bent or otherwise formed to provide a deflector plate 40 having a mounting means 42 extending upwardly therefrom. As will hereinafter be described, the entrainment baffle 38 is attached by the mounting means 42 to the lip 27 which extends across the top of the cooler pad assembly 18 so that the deflector plate 40 extends rearwardly angularly and downwardly therefrom into the trough 20 so as to be in spaced parallel coextending relationship with the water outlet slots 25 formed therein. The baffle 38 is configured so that the downwardly disposed edge of the deflector plate 40 is located proximate the bottom of the trough 20 which places the lower end of the deflector plate 40 under water during normal operation of the evaporative cooler 10. Thus, the water itself in conjunction with the deflector plate 40 will block the air flow which previously caused the entrainment problem described above.

In addition to blocking air flow through trough 20, the moisture entrainment baffle 38 will substantially reduce the splashing and sloshing of incoming water due to the deflector plate 40 being located, as previously described, so that it produces a dampening effect.

It will be noted that some air flow through the trough 20 will still occur around the ends of the baffle 38, however, the total amount of air flow will be reduced to a neglible value and the remaining air flow will entrain little or no moisture due to the tortuous path it must take into the interior of the cabinet.

The preferred form of the mounting means 42 is of special loop-shaped downwardly open cross sectional configuration which includes a substantially flat top surface 44 with a flange 45 depending normally from one longitudinal edge thereof and a depending transition surface 46 extending angularly from the opposite longitudinal edge toward the flange 45. The transitional surface 46 is angularly related to the deflector plate 40 and the juncture therebetween forms a longitudinally extending protrusion 47.

Mounting of the baffle 38 is accomplished by placing the top surface 44 and its depending flange 45 in hooked-over relationship with the lip 27 of the cooler pad assembly 18. This will position the top surface 44 so that it extends from the lip 27 and places the longitudinally extending protrusion 47 in bearing engagement with the mounting flange 21 of the trough 20 at a point considerably below its top edge.

The above described configuration of the mounting means 42 is preferred in that it allows the moisture entrainment baffle 38 to be demountably attached to cooler pad assemblies having various lip thickness dimensions, which may vary from one manufacturer to another, and due to the demountable feature, the baffle 38 may be easily removed to facilitate cleaning of the trough 20. The value of the demountable feature will be appreciated upon consideration of foreign materials and mineral deposition which can collect and build up in the trough 20 and eventually block water flow through water outlet slots 25 thereof. A further advantage of this particular embodiment of the entrainment baffle 38 is realized when the baffle is formed of a suitable plastic material so that the flange 45 of the baffle serves as an air leakage preventing gasket due to its being interposed between the outwardly disposed surface of the lip 27 and the depending edge of the cooler's inverted top pan 13. Also, the baffle 38 can be easily formed, such as by extrusion, to form an enlargement 48 on the depending edge of the flange 45 for hooked engagement with the depending edge of the folded over flange 21 of the trough 20. This particular embodiment of the baffle 38 can be supplied as a separate item for retrofit programs, and can be installed with a minimum expenditure of labor and time. In such a program, the baffle 38 can be supplied in lengths suitable to the particular coolers, or can be supplied in convenient lengths which are intended to be cut to suit particular installations.

Figure 4:
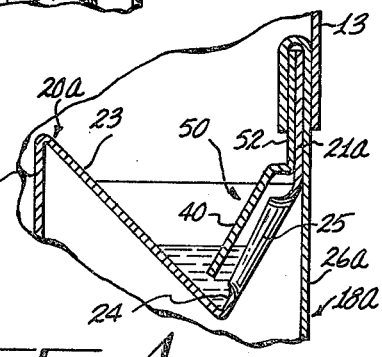
FIG. 4 is a fragmentary sectional view similar to FIG. 2*a* but illustrating a modification of the baffle of the present invention.

Reference is now made to FIG. 4, wherein, a modified form of moisture entrainment baffle 50 is shown. In this embodiment, the deflector plate 40 remains the same and the mounting means 52 which extends upwardly therefrom, is in the form of a flat plate which is angularly related to the deflector plate 40. This configuration of entrainment baffle 50 is suited for use in which installation thereof is accomplished during fabrication of the cooler pad assembly **18*a*. As shown, the cooler pad assembly 18*a* is formed with the upper edge of its louver plate 26*a* being folded back over the outwardly disposed mounting flange 21*a* of the trough 20*a* and the juxtaposed flat plate mounting means 52 of the baffle 50 and then is crimped or otherwise affixed so that the entrainment baffle forms part of the lip 27*a* of the cooler pad assembly 18*a***.

Figure 5:
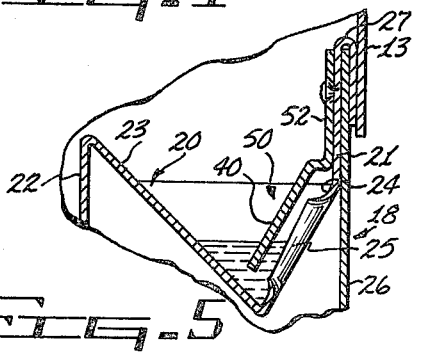
FIG. 5 is a fragmentary sectional view similar to FIG. 4 and illustrating still another modification of the baffle of the present invention.

Reference is now made to FIG. 5 wherein the entrainment baffle 50 is shown as being attached, such as by spot welding, to the inwardly disposed surface of the lip 27 which is formed on the top of the cooler pad assembly 18.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An improved cooler pad assembly for an evaporative cooler, said cooler pad assembly including a louver plate having a top edge with a water distribution trough adjacent that top edge and affixed thereto so as to form an upstanding lip, the water distribution trough having a plurality of spaced apart aligningly arranged water outlets formed therein, the improvement comprising, an entrainment baffle means including an elongated deflector plate extending into the water distribution trough in spaced coextending relationship with the water outlets thereof for blocking water entrainment which would otherwise occur as a result of air movement into the water distribution trough through the water outlets formed therein, and including a mounting means integral with one of the longitudinal edges of said deflector plate and extending therefrom into attached engagement with the lip of the cooler pad assembly.

2. An improved cooler pad assembly as claimed in claim 1 wherein said mounting means is of loop-shaped downwardly opening cross sectional configuration for hooked-over demountable attachment to the lip of the cooler pad assembly.

3. An improved cooler pad assembly as claimed in claim 1 wherein said mounting means is in the form of a flat plate for fixed attachment to the lip of the cooler pad assembly.

4. A cooler pad assembly for use in an evaporative cooler comprising:

(a) a louver plate having a top edge;

(b) a water distribution trough adjacent one of the surfaces of said louver plate and located below the top edge thereof, said trough having a mounting flange which is affixed to the top edge of said louver plate to form a lip thereon, said water distribution trough having a plurality of spacedly arranged water outlet slots formed therein; and (c) an entrainment baffle means including an elongated deflector plate which extends into said water distribution trough in spaced coextending relationship with the water outlet slots formed therein for blocking moisture entrainment which would otherwise result from air moving into said water distribution trough through the water outlet slots formed therein, said entrainment baffle means also including a mounting means extending upwardly and integrally from one of the longitudinal edges of said deflector plate into attached engagement with the lip formed by the mounting flange of said trough and the top edge of said louver plate.

5. A cooler pad assembly as claimed in claim 4 wherein said mounting means is of loop-shaped downwardly opening cross sectional configuration for hooked-over demountable attachment to the lip formed by the mounting flange of said trough and the top edge of said louver plate.

6. A cooler pad assembly as claimed in claim 4 wherein said mounting means is in the form of a flat plate for fixed attachment to the lip formed by the mounting flange of said trough and the top edge of said louver plate.

7. A cooler pad assembly for use in an evaporative cooler comprising:

(a) a louver plate having a top edge;

(b) a water distribution trough adjacent one surface of said louver plate immediately below the top edge thereof, said trough having an integral pair of downwardly converging trough walls with a mounting flange extending integrally and upwardly from the upper edge of one of the trough walls with that same trough wall having a plurality of spaced apart transversely disposed water outlet slots formed along the length thereof, the mounting flange of said trough attached to the top edge of said louver plate to form a lip;

(c) a deflector plate in spaced coextending relationship with the one of the trough walls of said trough in which the water outlet slots are formed, said deflector plate for blocking water entrainment which would otherwise occur as a result of air moving into said trough through the water outlet slots formed therein; and (d) mounting means extending integrally and upwardly from said deflector plate for attaching said deflector plate to the lip formed by the mounting flange of said trough and the top edge of said louver plate.

8. A cooler pad assembly as claimed in claim 7 wherein said mounting means is of downwardly opening loop-shaped cross sectional configuration for hooked-over demountable attachment to the lip formed by the mounting flange of said trough and the top edge of said louver plate.

9. A cooler pad assembly as claimed in claim 8 wherein said mounting means comprises:

(a) a substantially flat top surface;

(b) a flange integral with said top surface and depending normally from one edge thereof; and (c) a transition surface integral with said top surface and depending angularly from the opposite edge thereof toward said flange, said transition surface having its lower edge integral with said deflector plate, said transition surface angularly disposed with respect to said deflector plate which forms a protrusion at the junction therebetween with that protrusion in bearing engagement with the lip formed by the mounting flange of said trough and the top edge of said louver plate.

10. A cooler pad assembly as claimed in claim 7 wherein said deflector plate and said mounting means are formed of plastic.

11. A cooler pad assembly as claimed in claim 7 wherein said mounting means is in the form of a flat plate extending integrally and upwardly from said deflector plate for fixed attachment to the lip formed by the mounting flange of said trough and the top edge of said louver plate.

* * * * *